United States Patent [19]

Barthomeuf

[11] Patent Number: 5,002,136

[45] Date of Patent: Mar. 26, 1991

[54] DAMPED HAMMER DRILL

[75] Inventor: Jean-Claude Barthomeuf, Anse, France

[73] Assignee: Eimco-Secoma (Societe Anonyme), Meyzieu, France

[21] Appl. No.: 441,458

[22] Filed: Nov. 22, 1989

[30] Foreign Application Priority Data

Nov. 23, 1988 [FR] France ..... 88 15631

[51] Int. Cl.[5] ..... B25D 9/00

[52] U.S. Cl. ..... 173/114; 173/128; 173/139

[58] Field of Search ..... 173/102, 104, 113, 114, 173/128, 134, 139, DIG. 2

[56] References Cited

U.S. PATENT DOCUMENTS

| | | | |
|---|---|---|---|
| 3,060,894 | 10/1962 | Dean, Jr. et al. | 173/139 |
| 4,109,734 | 8/1978 | Montabert | 173/139 |
| 4,333,538 | 6/1982 | Ekwall | 173/104 |
| 4,593,768 | 6/1986 | Eklöf | 173/139 |

FOREIGN PATENT DOCUMENTS 2330507 6/1977 France .

*Primary Examiner*—Douglas D. Watts
*Assistant Examiner*—Scott A. Smith
*Attorney, Agent, or Firm*—Herbert Dubno; Andrew Wilford

[57] ABSTRACT

A hydraulic percussion apparatus has an elongated housing having a front nose piece and forming a chamber extending along an axis, a tool projecting axially backward through the nose piece into the housing and having in the nose piece an axially forwardly directed shoulder, and a piston axially reciprocal in the chamber and axially forwardly engageable with the tool. A high-pressure line, a low-pressure line, and a control valve can axially oppositely pressurize the piston and thereby hammer the piston against the tool. A sleeve surrounding the tool in the nose piece is displaceable axially in the nose piece between a full-forward end position axially forwardly abutting the housing and a full-rear end position axially abutting the housing and through an intermediate position between the end positions. This sleeve is formed with a radially outwardly open groove defining in the nose piece a damping compartment. A damping conduit in the housing has one end connected to the high-pressure line and an opposite end opening in the nose piece at a location opening into the groove only in and between the full-forward and intermediate positions of the sleeve. Thus this opposite end is blocked by the sleeve between the intermediate and full-rear positions of the sleeve.

8 Claims, 2 Drawing Sheets

DAMPED HAMMER DRILL

FIELD OF THE INVENTION

The present invention relates to a hammer drill. More particularly this invention concerns such a drill that is hydraulically powered.

BACKGROUND OF THE INVENTION

A standard hammer or percussion device has a hammer forming a cylinder in which is provided a piston that is longitudinally reciprocal and that defines in the cylinder a rear compartment and a front compartment. This piston moves longitudinally forward to strike the rear end of a tool, for instance a drill bit, and backward to return to a starting position spaced longitudinally behind the tool. The force for forward motion comes from the pressure differential between the front and rear compartment. The force for the return stroke comes in part from this differential and in part from the bit rebounding from the tool.

When such an arrangement is used in a hammer drill where the tool is rotated as well as longitudinally reciprocated, it is standard to provide a sleeve that axially surrounds the tool at the front end of the housing and that is axially reciprocal so that it can hammer back against the tool to assist in withdrawing it when, for instance, a deep hole is being drilled. Such a system is seen in French Patent 2,330,507.

A principal disadvantage of the known such system is that during each stroke the sleeve strikes twice against the housing of the tool itself so this housing absorbs part of the energy of the hammer piston. Clearly this can damage the housing.

In addition the systems known for facilitating withdrawal of the tool require an independent source of fluid under pressure. This makes the apparatus more complicated and expensive, and even increases the amount of energy it uses.

SUMMARY OF THE INVENTION

A hydraulic percussion apparatus according to this invention has an elongated housing having a front nose piece and forming a chamber extending along an axis, a tool projecting axially backward through the nose piece into the housing and having in the nose piece an axially forwardly directed shoulder, and a piston axially reciprocal in the chamber and axially forwardly engageable with the tool. A high-pressure line, a low-pressure line, and a control valve can axially oppositely pressurize the piston and thereby hammer the piston against the tool. A sleeve surrounding the tool in the nose piece is displaceable axially in the nose piece between a full-forward end position axially forwardly abutting the housing and a full-rear end position axially abutting the housing and through an intermediate position between the end positions. This sleeve is formed with a radially outwardly open groove defining in the nose piece a damping compartment. A damping conduit in the housing has one end connected to the high-pressure line and an opposite end opening in the nose piece at a location opening into the groove only in and between the full-forward and intermediate positions of the sleeve. Thus this opposite end is blocked by the sleeve between the intermediate and full-rear positions of the sleeve.

Thus each blow of the piston against the tool drives the sleeve forward with a speed that slows to zero, whereupon the sleeve moves backward under the hydraulic-spring effect of the liquid in the damping compartment. After some limited travel in the return stroke the feed to the damping compartment is cut off, so that once again the rearward velocity slows, stops, and reverses. Thus on the return stroke the sleeve will not strike the housing at all, and the system consumes no useful hydraulic energy.

According to a feature of this invention the sleeve has a front and a rear large-diameter portion together defining the groove. The rear portion is of larger diameter than the front portion. The housing has at the nose piece a rearwardly directed shoulder flatly engageable with the front face of the rear portion in the full-forward position of the sleeve and the front portion covers the location between the intermediate and full-rear portions of the sleeve.

Furthermore according to this invention the conduit is connected to the high-pressure line upstream of the control valve. This completely eliminates the need for a separate feed for the damping unit.

The system of this invention can also be provided with a relief conduit in the housing having one end opening into the high-pressure line downstream of the one end of the damping conduit and an opposite end opening into the chamber at a location axially level with the location of the relief conduit. A check valve is provided in one of the conduits, normally in the relief conduit so a only to permit flow from the high-pressure line to the chamber. This relief-conduit arrangement provides for liquid exchange through the damping compartment to avoid heat buildup therein.

Respective auxiliary conduits can be connected between the relief and damping conduits and the chamber and respective locations open into the chamber offset axially from the locations of the opposite ends of the relief and damping conduits. Furthermore the piston has a relatively small forwardly facing piston face exposed at a front compartment permanently connected to the high-pressure line and a relatively large rearwardly facing piston face on the piston exposed at a rear compartment. The control valve is connected between both lines and to the rear compartment to alternately connect the rear compartment to the lines.

DESCRIPTION OF THE DRAWING

The above and other objects, features, and advantages will become more readily apparent from the following, reference being made to the accompanying drawing in which.

SPECIFIC DESCRIPTION

Figure 1:
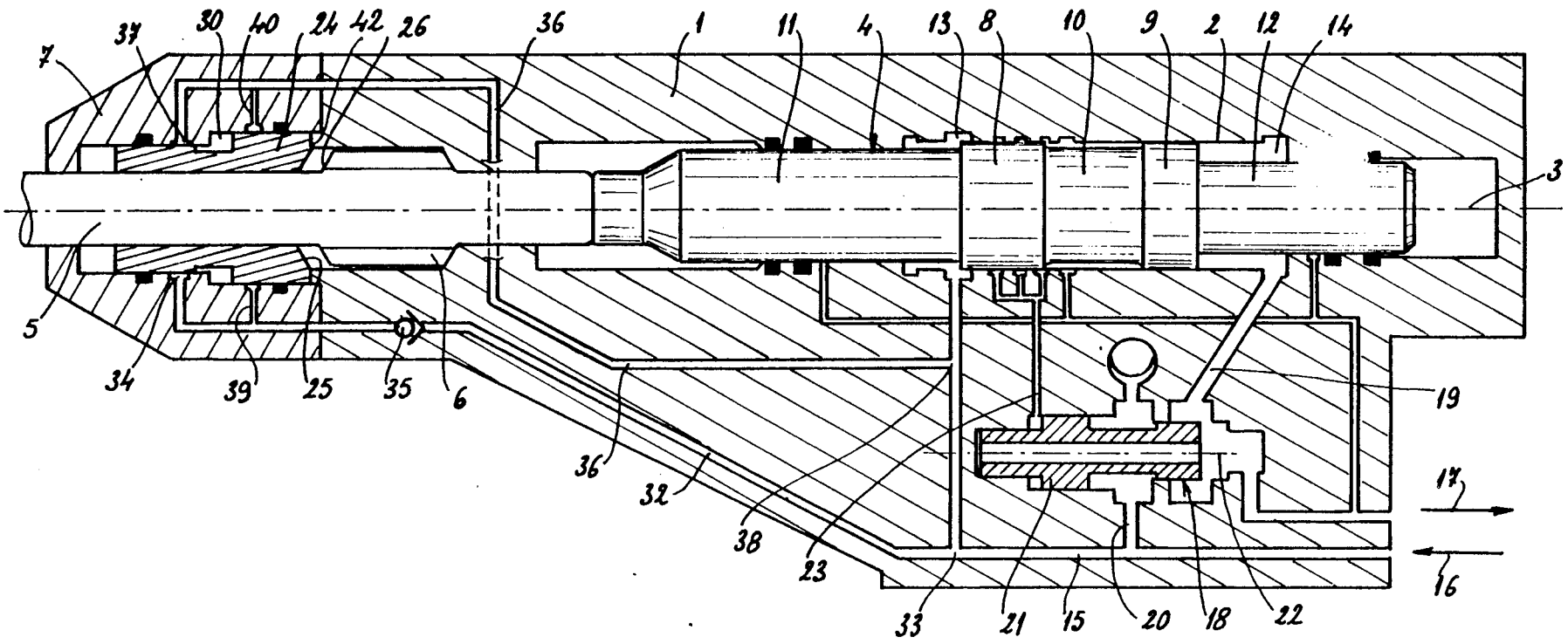
FIG. 1 is an axial section through the tool according to this invention.

FIG. 1 shows a percussion tool having an elongated housing 1 forming a cylinder or chamber 2 centered on an axis 3. A hammer piston 4 in the chamber 2 can move axially to strike the rear end of a tool whose shank is shown at 5. This tool 5 has splines 6 that mesh with a pinion of a motor shown diagrammatically at 43 for rotation of this tool 5 about the axis 3. The housing 1 is provided with a removable nose piece 7 through which the tool 5 is fitted for mounting in the apparatus.

The piston 4 is stepped, having a pair of axially spaced collars or large-diameter portions 8 and 9 separated by and defining an annular groove 10. In addition this piston 4 has forward of the front collar 8 a large-diameter portion 11 and a backward of the rear collar 9 a small-diameter portion 12. Respective compartments 13 and 14 in the chamber 2 are provided respectively forward and backward of the collars 8 and 9, the effective surface area of the collar 8 exposed in the compartment 13 being substantially smaller than that of the collar 9 exposed in the compartment 14.

The front compartment 13 is permanently connected with a high-pressure feed conduit 15 connected to a pressure source indicated schematically by arrow 16. Another such conduit or passage 19 is connected from the rear compartment 14 to a valve 18 and thence through a branch line 20 to the conduit 15 or to a vent conduit 44 connected to a sump indicated diagrammatically by arrow 17. The valve 18 is of the reversing type and has a spool 21 centered on an axis 22 and automatically shuttling back and forth as is known per se under the control of pressure fed in via a pilot line 23 itself connected via further pilot lines 45 to the sump 17 as the piston 4 reciprocates. The operation of this valve is described in a greater detail in U.S. Pat. No. 4,806,645.

According to this invention the apparatus has a damping sleeve 24 coaxially surrounding the tool 5 ahead of its splines 6 inside the nose piece 7. The sleeve 24 has a frustoconically tapered rear face 25 engageable with a complementary such face 26 formed by the front ends of the splines 6.

In addition the sleeve 24 has front and rear large-diameter portions 27 and 28, the latter being of greater diameter than the former, separating an annular groove 29 defining in the nose piece 7 an annular chamber 30 that is forwardly delimited by a shoulder 31 of this nose piece 7.

Figure 3:
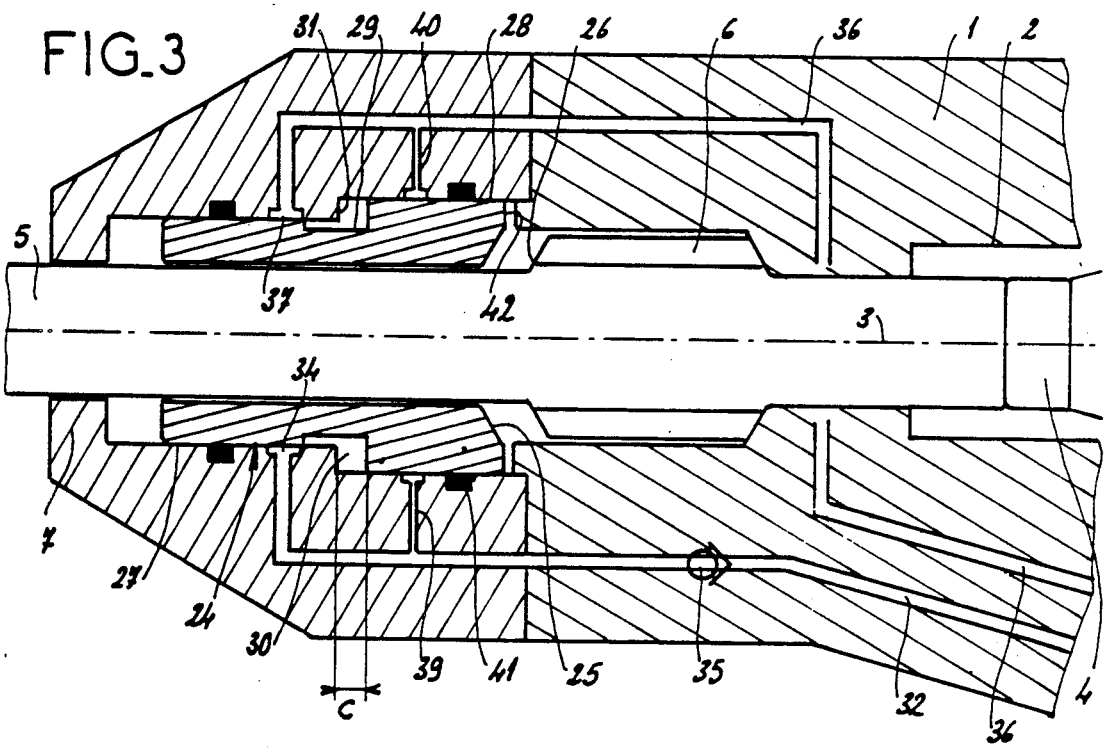

A passage 32 connected permanently at 33 to the high-pressure feed line 15 opens radially at 34 into the chamber 2 at a location that can be covered by the sleeve portion 27 in its rear position seen in FIG. 3. A check valve 35 prohibits flow back toward the passage 15.

Another passage 36 opens at a mouth 37 axially level with the mouth 34 into the chamber 2 and is connected at 38 to the high-pressure feed line 15 downstream of the connection location 33, that is closer to the compartment 13. Furthermore auxiliary branch passages 39 and 40 extend from the conduits 32 and 36 to locations opening on the sleeve portion 28 so as to keep the seal 41 there lubricated.

The apparatus described above operates as follows:

When a hole is being drilled with simultaneous tool rotation and reciprocation the damping system of the sleeve 24 is not effective. The shoulder 26 of the tool 5 remains spaced axially backward from the face 25 of the sleeve 24. The sleeve 24 itself will sit without moving in the position generally shown in FIG. 3.

Figure 2:
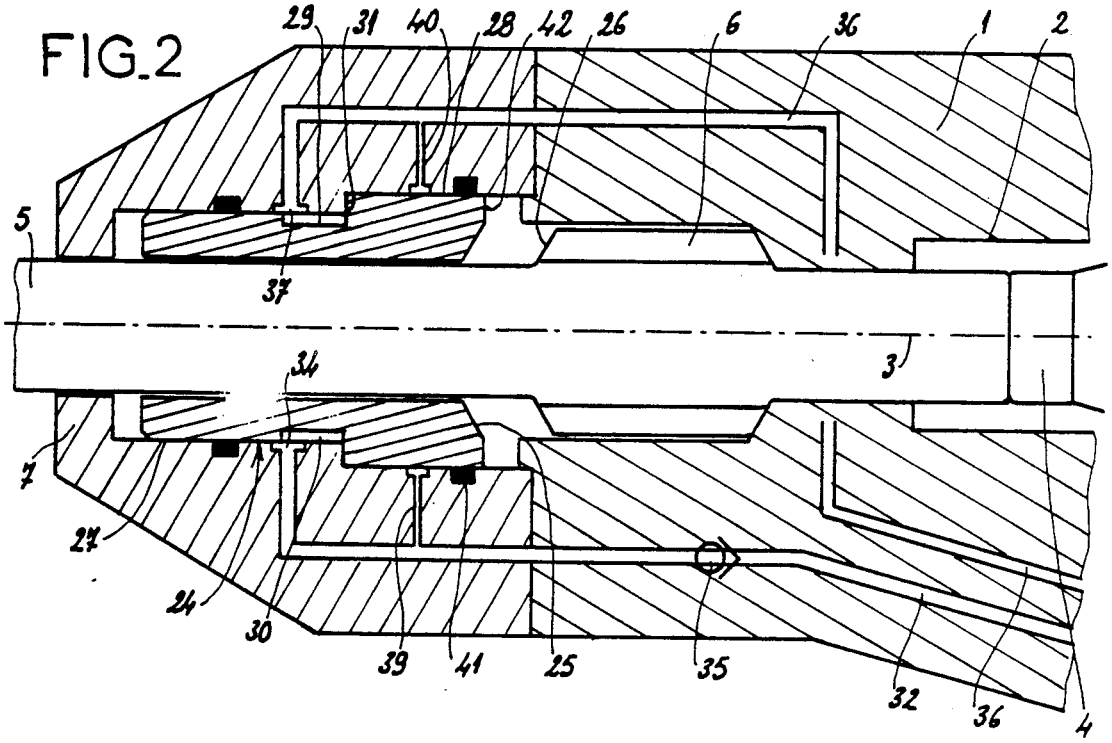
FIGS. 2 and 3 show in detail the damping arrangement in the full-forward and intermediate positions.

During withdrawal of the tool 5 from a drilled hole while the tool is being rotated but without hammering, that is with no pressure in the line 15, the damping sleeve 24 is also without effect. The face 26 of the tool 5 will rest against the rear face 25 of the sleeve 24, and this sleeve 24 will be in its fully forward position indicated in FIG. 2 with the front face of the rear portion 28 abutting the rearwardly directed shoulder 31 of the nose piece 7. In this position of the sleeve 24 the mouth 34 of the conduit 32 opens into the chamber 30.

If during such withdrawal of the tool 5 the line 15 is pressurized for hammer assist the chamber 30 becomes pressurized and the sleeve 24 is pushed axially backward, that is toward the right in the drawing. The effective surface area of the front face of the portion 28 is substantially larger than the effective surface area of the front face of the collar 8, so that the backward force this sleeve 24 can exert is substantially greater than any that could be exerted by the piston 4. At the same time the alternating pressurization and depressurization of the rear compartment 14 by the valve 18 will ensure that the tool 5 will continue to reciprocate axially. The normal forward hammering of the piston 4 is therefore partially absorbed by the liquid in the chamber 30 since the tool 5 is still bearing with its surface 26 against the rear face 25 of the sleeve 24. The sleeve 24 thus receives impact from the tool 5 and will move forward then back, with the pressure in the chamber 30 acting as a hydraulic spring.

The conduit 32 is placed in communication with the chamber 30 when the groove 29 is moved axially forward over the mouth 34. Thus with each impact of the piston 4 on the tool 5 the chamber 30 acts as a hydraulic damper. Between successive impacts the sleeve 24 is pushed backward by the pressure in the chamber 30. Nonetheless after a certain rearward stroke C the front portion 27 of the sleeve 24 covers the mouth 34 of the conduit 32 so as to cut off the supply of liquid under pressure to the chamber 30 as shown in FIG. 3. Thus once this position is reached rearward movement of the sleeve 24 is slowed markedly so that the sleeve 24 does not actually strike the housing 1 with its rear face 42. The stroke C is shorter than the total possible axial movement of the sleeve 24 in the housing 1. In addition covering the mouth 34 of the conduit 32 takes place progressively so that there is a progressive slowing of the rearward movement of the sleeve 24.

The above-described operation only actually requires a single supply of liquid to the chamber 30. The second conduit 36 serves purely to carry off some of the liquid with each stroke to prevent a build up of heat in the liquid of the nose piece 7. The check valve 35 ensures that the circulation will be from the passage 32 to the passage 36. The passage 36 in turn empties at a location 38 into the line 15 so that the liquid from it goes directly to the chamber 13 and is not recirculated to the nose piece 7.

Thus the system of this invention provides hammering on withdrawal of the tool without actually impacting the housing. No extra source of liquid under pressure is needed for the damping action and this damping action consumes virtually none of the hydraulic energy supplied to the apparatus.

The described apparatus is particularly useful for drilling relatively deep holes where often several bits are joined end-to-end so that withdrawal of the bits can be quite difficult.

Other uses of the damping system of this invention are of course to be included in the scope of the following claims. The damping arrangement could be used in a purely reciprocating instrument, for instance a jack hammer or scaler, as well as in the illustrated rotary drill.

I claim:

1. A hydraulic percussion apparatus comprising:

an elongated housing having a front nose piece and forming a chamber extending along an axis;

a tool projecting axially backward through the nose piece into the housing and having in the nose piece an axially forwardly directed shoulder;

a piston axially reciprocal in the chamber and axially forwardly engageable with the tool;

means including a high-pressure line, a low-pressure line, and a control valve for axially oppositely pressurizing the piston and thereby hammering the piston against the tool;

a sleeve surrounding the tool in the nose piece and displaceable axially in the nose piece between a full-forward end position axially forwardly abutting the housing and a full-rear end position axially abutting the housing and through an intermediate position between the end positions, the sleeve being formed with a radially outwardly open groove defining in the nose piece a damping compartment; and a damping conduit in the housing having one end connected to the high-pressure line and an opposite end opening in the nose piece at a location opening into the groove only in and between the full-forward and intermediate positions of the sleeve, the opposite end being blocked by the sleeve between the intermediate and full-rear positions of the sleeve.

2. The percussion apparatus defined in claim 1 wherein the sleeve has a front and a rear large-diameter portion together defining the groove, the rear portion being of larger diameter than the front portion and having a front face, the housing having at the nose piece a rearwardly directed shoulder flatly engageable with the front face of the rear portion in the full-forward position of the sleeve, the front portion covering the location between the intermediate and full-rear portions of the sleeve.

3. The percussion apparatus defined in claim 1 wherein the conduit is connected to the high-pressure line upstream of the control valve.

4. The percussion apparatus defined in claim 1, further comprising:

a relief conduit in the housing having one end opening into the high-pressure line downstream of the one end of the damping conduit and an opposite end opening into the chamber at a location axially level with the location of the relief conduit.

5. The percussion apparatus defined in claim 4, further comprising a check valve in one of the conduits.

6. The percussion apparatus defined in claim 5 wherein the one conduit is the relief conduit, the valve only permitting flow from the high-pressure line to the chamber.

7. The percussion apparatus defined in claim 4, further comprising respective auxiliary conduits connected between the relief and damping conduits and the chamber and respective locations open into the chamber offset axially from the locations of the opposite ends of the relief and damping conduits.

8. The percussion apparatus defined in claim 1 wherein the means includes a relatively small forwardly facing piston face on the piston;

a front compartment at the forward piston face and permanently connected to the high-pressure line;

a relatively large rearwardly facing piston face on the piston; and a rear compartment at the rear piston face, the control valve being connected between both lines and to the rear compartment to alternately connect the rear compartment to the lines.

* * * * *